United States Patent [19]

Mirsch

[11] 4,128,824

[45] Dec. 5, 1978

[54] MULTILAYERED DEFLECTION YOKE

[75] Inventor: John W. Mirsch, Levittown, Pa.

[73] Assignee: RCA Corporation, New York, N.Y.

[21] Appl. No.: 837,854

[22] Filed: Sep. 29, 1977

[51] Int. Cl.[2] ..... H01F 5/00

[52] U.S. Cl. ..... 335/213; 335/210

[58] Field of Search ..... 335/213, 210

[56] References Cited

U.S. PATENT DOCUMENTS

| | | | |
|---|---|---|---|
| 3,757,224 | 9/1973 | Fedorko et al. | 335/213 |
| 3,757,262 | 9/1973 | Over et al. | 335/210 |

*Primary Examiner*—Harold Broome

*Attorney, Agent, or Firm*—Eugene M. Whitacre; Paul J. Rasmussen; Joseph Laks

[57] ABSTRACT

A deflection yoke comprises a core and at least two layers of conductor turns wound about the core. A return traverse conductor traverses the core from a finishing conductor turn of one of the layers to a starting conductor turn of the other layer. At least three projections are located adjacent an outer surface of the core for providing pivot points for the return traverse conductor. A first projection is located near a starting conductor turn of one of the layers, a second projection is located near a finishing conductor turn, and a third projection is located between the first and second projections for preventing the return traverse conductor from protruding beyond a core end.

9 Claims, 6 Drawing Figures

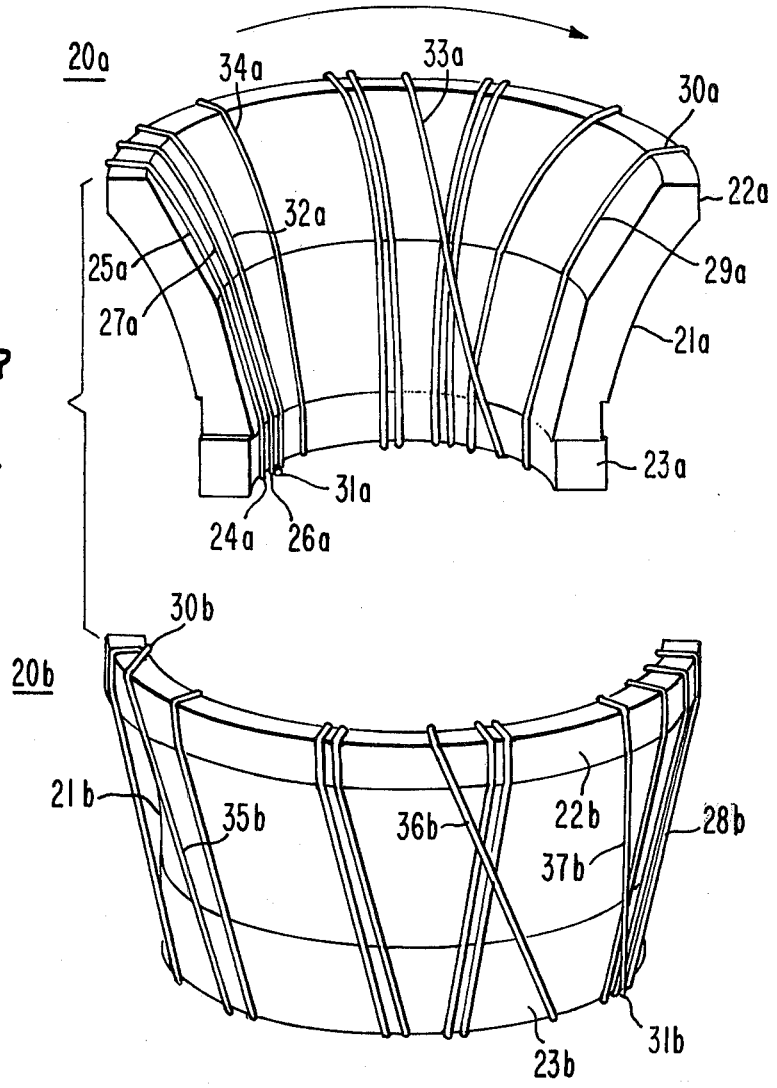
PRIOR ART Fig. 1.
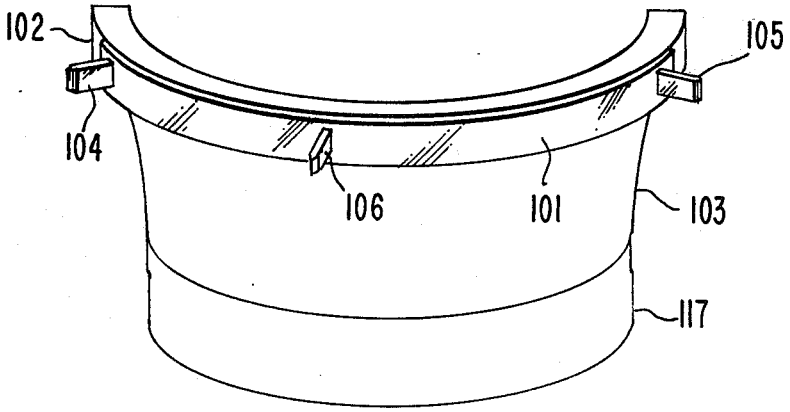
Fig. 2.

MULTILAYERED DEFLECTION YOKE

BACKGROUND OF THE INVENTION

This invention relates to deflection yokes for television receivers.

To provide deflection of the electron beams in a cathode ray tube of a television receiver, a deflection yoke comprising vertical and horizontal windings is mounted over the neck of the cathode ray tube. For a saddle-type yoke, all the coils comprising both the horizontal and vertical windings are formed into a conventional saddle shape and are placed into an appropriately shaped housing and mounting structure. For a full toroidal deflection yoke, both the horizontal and vertical windings comprise a plurality of conductor turns wound around a toroidal core of magnetically permeable material that is generally shaped into a hollow cylinder, flared at one end. For a saddle-toroid (ST) or hybrid yoke, the horizontal winding comprises two saddle shaped coils that are placed into a nonmagnetic saddle shaped housing with the coils being symmetrically disposed about the horizontal axis and plane. The vertical winding typically comprises two coils, each coil toroidally wound around the upper or lower half, respectively, of a split toroidal core. After the winding is completed, each core piece is placed against the outside of the saddle shaped housing, with each of the vertical coils being symmetrically disposed about the vertical axis and plane.

With both the full toroidal yoke and vertical toroidal portion of the hybrid yoke, it may be desirable to wind the conductor turns into multiple layers, each layer with a particular angular distribution of conductor turns for generating a deflection magnetic field that will also correct for convergence errors, such as coma and astigmatism. When winding these multiple layers, as by means of a conventional indexing type toroidal winding machine, it is desirable to return to the starting position of the second or next subsequent layer from the finishing position of the first or immediately preceding layer in the quickest and most direct manner.

SUMMARY OF THE INVENTION

A deflection yoke comprises a core and at least two layers of conductor turns toroidally wound about the core. A return traverse conductor traverses the core from a finishing conductor turn of one of the layers to a starting conductor turn of the other layer. At least three projections are located adjacent an outer surface of the core for providing pivot points for the return traverse conductor. A first projection is located near a starting conductor turn of one of the layers, a second projection is located near a finishing conductor turn, and a third projection is located between the first and second projections for preventing the return traverse conductor from protruding beyond a core end.

BRIEF DESCRIPTION OF THE DRAWINGS

FIG. 1 illustrates a prior art method of return traverse from the finish of one layer to the beginning of the next layer;

FIG. 2 illustrates a core piece according to the invention;

DESCRIPTION OF THE INVENTION

Figure 3:
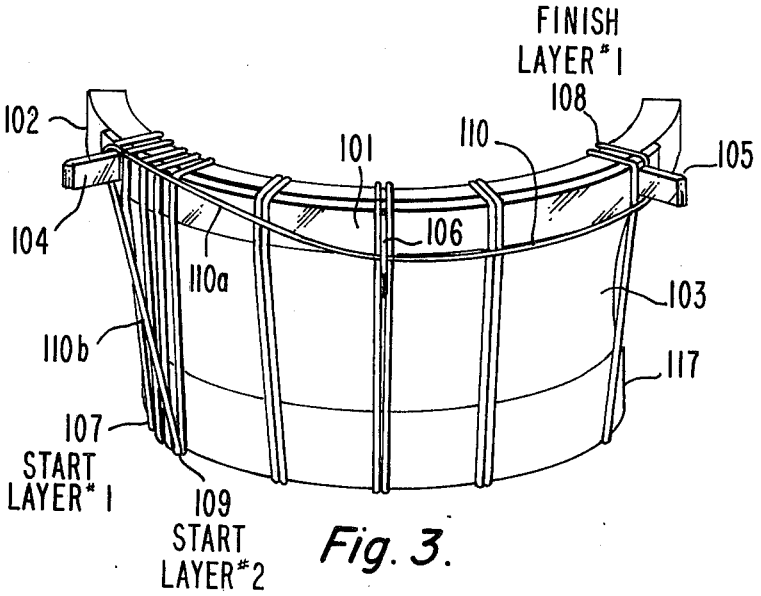
FIGS. 3 and 4 illustrate deflection yoke arrangements embodying the invention.

Various prior art methods have been used to return to the start of a new layer of conductor turns from the finish of a previous layer. Illustrated in FIG. 1 is the spiral back method of return used for each of the two vertical coil assemblies 20*a* and 20*b* of a hybrid yoke. A similar technique may be used for a full toroidal yoke. A toroidal core is split into two pieces 21*a* and 21*b* with flared ends 22*a* and 22*b* and narrow ends 23*a* and 23*b*, respectively. Each coil assembly is wound separately on its respective winding machine in the same manner. The machine rigidly clamps a core piece, core piece 21*a*, for example, with the longitudinal axis of the core oriented in a Y, or in a vertical, direction. The flyer of the winding machine, to which one end of a spool of conductor wire is attached, is indexed in an X, or a horizontal, direction until the starting position 24*a* of the first layer of conductor turns is reached. The flyer then begins to wind upward around the core piece on the inside, thereby emplacing a starting conductor turn of the first layer against core piece 21*a*, illustrated in FIG. 1 as the first inside conductor turn 25*a*. The inside conductor turns when energized with scanning current are the active turns which provide the deflection magnetic field.

Once past the flared end 22*a* of core piece 21*a*, the winding machine flyer begins to wind downward around the outside of core piece 21*a*. Simultaneously with the downward motion of the flyer, the flyer is indexed to the left as indicated by the arrow in FIG. 1, to the beginning location 26*a* of the second active inside conductor turn 27*a*. Upon reaching location 26*a*, the flyer will have emplaced the first outside return conductor 28*a*, not shown in FIG. 1, against core piece 21*a*. The corresponding first outside return conductor of vertical coil assembly 20*b* is identified in FIG. 1 as element 28*b*.

The remaining inside conductor turns are emplaced by further indexing the flyer to various locations, determined by the particular winding distribution selected until the last inside conductor turn 29*a* has been emplaced, conductor turn 29*a* thereby being considered the finishing conductor turn of the first layer. For greater clarity, many of the inside conductor turns and outside return conductors have been omitted from FIG. 1. It should be noted that although a specific winding and indexing method has been described, other conventional winding techniques may also be used. Conventional anchoring techniques, omitted from the above description, may be used for ensuring the fixed emplacement of the first several conductor turns for preventing movement of the conductor wires.

After completing the emplacement of the first layer of conductor turns, the flyer will be located at the finishing position 30*a* of core piece 21*a*. The starting position of the second layer is illustratively shown as location 31*a* and is located between inside conductor turn 27*a* and the next conductor turn 32*a*. For vertical coil assembly 20*b*, the corresponding finishing position of the first layer is location 30*b*, and the starting position of the second layer is location 31*b*.

In the spiral back method of return traverse, the flyer continuously winds about both the inside and outside surfaces of the core piece. At the same time, the flyer is indexed continuously in a direction opposite the previous one; that is, the flyer is indexed to the right until location 31*a* is reached, at which point the emplacement of the second layer of conductor turns begins. During the traverse, the flyer will have emplaced return traverse conductors on both the inside and outside surfaces of the core piece, a return traverse conductor being defined as a conductor emplaced in traversing from the finishing position of one layer to the starting position of another layer.

The return traverse conductors for vertical coil arrangement 20*a* are illustrated as inside conductors 33*a* and 34*a* and outside conductors 35*a*, 36*a* and 37*a*, not shown in FIG. 1. The corresponding conductors for vertical coil arrangement 20*b* are outside conductors 35*b*, 36*b* and 37*b*, and inside conductors 33*b* and 34*b*, not shown.

As illustrated in FIG. 1, both the inside and outside return traverse conductors are cross-turn conductors; that is, their direction of emplacement is at a substantial angle with the longitudinal direction, in which longitudinal direction the active inside conductor turns of the first layer are emplaced. Factors such as the diameter of the conductor wire used and the dimensions of the flared and narrow ends of the core will determine the greatest angle to the longitudinal axis at which the cross-turn conductors may be emplaced without slipping from their anchored positions. Typically, two or three inside and outside return traverse conductors will be emplaced in a traverse extending typically approximately 140° along each core piece.

The spiral back method, although providing a relatively fast return traverse, has the disadvantage of necessitating the emplacement of cross-turn conductors on the inside active surface of the core piece. Precision placement of the inside conductor turns of the second and subsequent layers is made difficult since the conductor turns will be emplaced over the return traverse cross-turn conductors. Use of the spiral back method also results in a relative decrease is sensitivity of the inside conductor turns of the first several layers. Since succeeding layers must be emplaced over the cross-turn conductors, each layer will further bulge or protrude into the inside space of the core. To prevent contact with the cathode ray tube envelope, the core and yoke housing must be designed to locate the first several layers farther away than may be desirable from the cathode ray tube envelope and thus also farther away than may be desirable from the electron beams within the envelope. The sensitivity of the conductor turns of the first layers will decrease, thereby requiring more conductor turns or a greater scanning current through the coils to produce the proper strength magnetic deflection field.

To eliminate the inside cross-turn conductors, the return traverse may be accomplished by another prior art method, the flyback return method. Instead of indexing continuously back to a starting position during the return traverse, the flyer periodically stops at designated locations. By creating gaps in the inside conductor turn emplacement during the forward indexing of the preceding layer emplacement, these designated locations will be empty of inside conductor turns. When reaching one of these locations during a return traverse, the flyer stops, emplaces an inside conductor turn longitudinally, then continues to index as it moves along the outside surface of the core piece until another gap location is reached and then emplaces another longitudinal conductor turn. These steps are repeated until the starting position of the next layer is reached.

Using the flyback method, only the outside return traverse conductors are cross-turn conductors. The inside return traverse conductors are no longer cross-turn types, with the disadvantages mentioned above, but are actually part of the active inside conductor turns of the preceding layer or layers.

Typically, seven or eight flyback type return traverse conductors are required when traversing 140° of core extension. Thus, the flyer must slow down or come to a halt a relatively large number of times when indexing to the gap positions and when emplacing the inside conductor turns at those gap positions. These stoppages increase the time required to emplace a layer of conductor turns and increase the winding time to complete a multiple layer core piece.

Furthermore, it has been observed that the inside conductor turns emplaced during the return traverse will have impressed upon them a horizontal rate ringing voltage that is induced by the magnetic flux generated by the current in the horizontal winding. It is therefore desirable to return traverse with as few inside conductor turns as practical in order to maintain the amplitude of any ringing voltage as small as possible.

Figure 4:
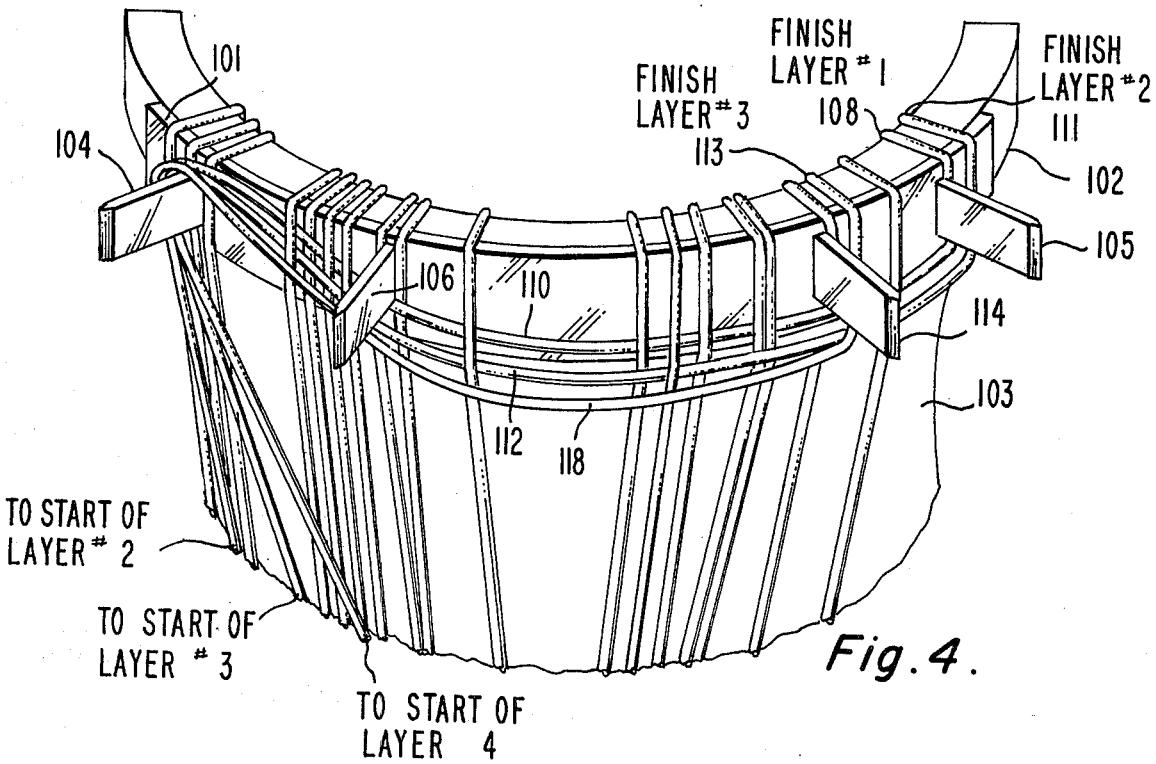

A deflection yoke embodying the invention and minimizing the above-described ringing voltage and quickly return traversing to the start of the next layer is illustrated in FIGS. 2–4.

As illustrated in FIG. 2, a nonmagnetic plastic strip 101 is affixed along the outer surface of a flared end 102 of a core piece 103 with the other end 117 of core piece 103 being narrow. The strip includes outward projections 104–106. Projection 104 is located adjacent the starting conductor turns of a layer of conductor turns, not shown in FIG. 2. Projection 105 is located adjacent the finishing conductor turns of a layer, and intermediate projection 106 is located between projections 104 and 105 at a location hereinafter to be described.

As illustrated in FIG. 3, winding of the first layer begins conventionally at starting position 107 and continues until the finishing position 108 is reached to the right of projection 105. The starting position of the second layer is illustratively selected as position 109. A feature of the invention is to use projections 104–106 to return traverse to position 109 in a quick and direct manner with the return traverse conductor 110 being entirely emplaced along the outside surface of core piece 103 over the previously emplaced outside return conductors.

After reaching finishing position 108, the flyer winds in a downward direction for some distance, after which distance, the flyer is then indexed back to the starting position 109 of the second layer. As illustrated in FIG. 3, projection 105 provides a pivot point for return traverse conductor 110 for pivoting the conductor to a direction which will result in the shortest path for the conductor between projections 104 and 105. Conductor 110 therefore generally extends in a direction orthogonal to the longitudinal axis of core piece 103. Projection 104, located near the starting conductor turns of the first and second layers, provides a pivot point for return traverse conductor 110 for pivoting to a direction which is generally along the longitudinal axis for reaching starting position 109.

Intermediate projection 106 provides an intermediate pivot point for return traverse conductor 110 to prevent the conductor from protruding beyond flared end 102 and interfering with the emplacement of subsequent layers. The exact location of projection 106 will depend upon such factors as the curvature of flared end 102 and the diameter of the conductor wire used. For a relatively sharply curved flared end 102, in order to prevent protrusion of the return traverse conductor beyond the end, intermediate projection 106 will be located closer to projection 104 and farther away from projection 105 than it would be for a less sharply curved flared end. However, if intermediate projection 106 is located too closely to projection 104, the portion 110*a* of return traverse conductor 110 located between projections 104 and 106 would be required to pivot upward at an angle greater than may be feasible.

As illustrated in FIG. 4, the emplacement of multiple layers is possible with a core piece constructed according to the invention. The finishing position of the first layer is at position 108. The first return traverse conductor 110 pivots around projection 105, then around projection 106, and finally around projection 104 towards the starting position of the second layer. The second layer is wound until its finishing position 111 is reached. A return traverse conductor 112 then pivots around projections 104–106 to the start of the third layer. The finishing position of the third layer is location 113 to the left of projection 105. For such situations, it may be desirable to incorporate onto strip 101 a fourth projection 114 adjacent projection 105. Alternatively, projection 105 solely may be used if it is placed inwardly of all the finishing positions of all the appropriate layers. A return traverse conductor 118 again pivots around projections 104–106 to the start of the fourth layer. Additional layers may be emplaced in a similar manner as described. It should be noted, that the starting and finishing positions exemplified in FIGS. 3 and 4 have been selected to provide greater clarity in illustration. In actual practice, the positions will differ, depending on the winding distribution desired. For similar reasons, many of the longitudinally emplaced conductors have also been omitted.

The length that each projection must extend outwardly from core piece 103 will depend upon such factors as the number of layers emplaced, the number of return traverse conductors that are to pivot around each projection, and the approach distance to the core piece that the flyer reaches in the vicinity of each projection. The thickness of each projection will depend upon such factors as the length of each projection and the force on each projection that the flyer develops as a conductor wire is being pivoted around the projection.

Figure 5:
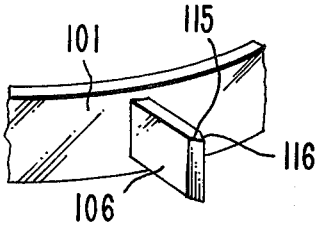

It is desirable that the outer tips of each projection be pointed, as illustrated in FIG. 5, with the upper portion of each projection, projection 106 exemplified in FIG. 5, comprising beveled surfaces 115 and 116. With a pointed tip, the outer longitudinally directed return conductors emplaced by the flyer near a projection will not become lodged on top of the projection but will slip down one or the other of the sides. Because the outer return conductors near a projection will be displaced sidewards, a projection should be as thin as possible, consistent with the above stated criteria, in order to prevent the return conductors from being emplaced at too great an angle with respect to the longitudinal direction. Typically, a projection thickness will be less than two or three conductor wire diameters, if precision emplacement is desired.

Figure 6:
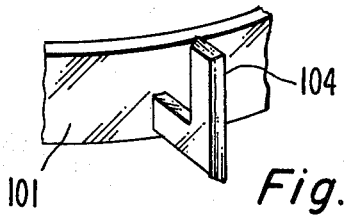
FIGS. 5 and 6 illustrate variously shaped projections according to the invention.

Other shaped projections may also be used such as outwardly protruding pins of appropriate thickness. Instead of generally rectangular shaped projections, hook-shaped projections, such as illustrated for projection 104 in FIG. 6, may also be used. Alternatively, the core itself may be formed with appropriately shaped and located projections.

A feature of the invention is that by using at least three projections, the projections may be advantageously located at the flared end 102 of core piece 103. Location at the flared end is desirable for several reasons. At that end, the flyer is at a closer approach distance to the core piece than farther down towards the narrow end of the core piece, thereby permitting a shorter, thinner projection to be used.

Furthermore, location of the projections at the flared end permits greater freedom to locate at the narrow end 117 the starting position of a subsequent layer. As illustrated in FIG. 3, starting position 109 is located in the groove between conductor wires previously emplaced. A shallow angle for return traverse conductor portion 110*b* with respect to the longitudinal direction will prevent conductor portion 110*b* from sliding away from its correct location at position 109. Also, less pivoting force on the projection will be developed. Typically, angles of less than 15° or 20° to the longitudinal axis are desirable for 23 or 25 gauge conductor wire in order to prevent the wire from sliding out of its groove.

Still further, to a certain extent, the upper layers of the outside longitudinally directed return conductors will bulge both outward and sideways in the vicinity of a projection. If projection 104, for example, is located near the narrow end 117 where the density of emplaced conductors is relatively large, then the return conductors will be displaced by a greater amount than desirable near that end. It will be difficult, therefore, to emplace a return conductor exactly at the desired location at end 117 for precision emplacement of the next respective inside active conductor turn.

What is claimed is:

1. A deflection yoke comprising:

a core;

at least two layers of conductor turns wound about said core, including a return traverse conductor traversing said core from a finishing conductor turn of one of said first and second layers to a starting conductor turn of the other of said layers;

at least three projections located adjacent an outer surface of said core for providing pivot points for said return traverse conductor, a first projection located near a starting conductor turn of at least one of said first and second layers, a second projection located near a finishing conductor turn of at least one of said first and second layers, and a third projection located between said first and second projections for preventing said return traverse conductor from protruding beyond an end of said core.

2. A yoke according to claim 1 wherein said three projections are located adjacent a flared end of said core.

3. A yoke according to claim 2 wherein said three projections are substantially in line in a direction generally orthogonal to a longitudinal axis of said core.

4. A yoke according to claim 2 wherein the upper portion of at least one of said projections is so constructed as to permit sliding of a conductor wire to a side of the projection as said conductor wire is being emplaced.

5. A yoke according to claim 2 wherein said second projection provides a pivot point for pivoting said return traverse conductor in a generally orthogonal direction relative to the longitudinal axis of said core.

6. A yoke according to claim 5 wherein first projection provides a pivot point for pivoting said return traverse conductor in a generally longitudinal direction.

7. A yoke according to claim 6 wherein said deflection yoke comprises a saddle-toroidal yoke, said layers of conductor turns comprising a portion of the vertical deflection winding.

8. A yoke according to claim 6 wherein a fourth projection is located near the second projection for providing a pivot point for a finishing conductor turn of a third layer of conductor turns.

9. A deflection yoke comprising:

a core;

at least two layers of conductor turns wound about said core, including a return conductor coupling a finishing conductor turn of said first layer with a starting conductor turn of said second layer; and at least three projections located adjacent an outer surface of said core, said first projection located adjacent a finishing conductor turn of said first layer for providing a pivot point for said return conductor for pivoting said return conductor to a direction generally transverse to a longitudinal axis of said core, said second projection located adjacent a starting conductor turn of said second layer for providing a pivot point for said return conductor for pivoting said return conductor to a direction generally along said longitudinal axis, said third projection located between said first and second projections for providing an intermediate pivot point for said return conductor for preventing said return conductor from protruding beyond said end.

* * * * *